United States Patent [19]

Worthington

[11] 4,445,931

[45] May 1, 1984

[54] PRODUCTION OF METAL POWDER

[75] Inventor: Robert B. Worthington, Albany, Oreg.

[73] Assignee: The United States of America as represented by the Secretary of the Interior, Washington, D.C.

[21] Appl. No.: 340,925

[22] Filed: Jan. 20, 1982

Related U.S. Application Data

[63] Continuation-in-part of Ser. No. 200,109, Oct. 24, 1980, abandoned.

[51] Int. Cl.[3] ..... B22F 9/28

[52] U.S. Cl. ..... 75/0.5 B; 75/0.5 BB; 75/0.5 C; 75/84.4; 75/84.5

[58] Field of Search ..... 75/0.5 BB, 0.5 B, 0.5 BA, 75/84.4, 84.5, 0.5 C

[56] References Cited

U.S. PATENT DOCUMENTS

| | | | |
|---|---|---|---|
| 2,881,067 | 4/1959 | Hivert et al. | 75/0.5 BB |
| 2,892,697 | 6/1959 | Davies et al. | 75/0.5 BB |
| 2,950,185 | 8/1960 | Hellier et al. | 75/0.5 BB |
| 2,984,560 | 5/1961 | Dombrowski | 75/0.5 BB |
| 3,415,639 | 12/1968 | Daendliker et al. | 75/0.5 BB |
| 3,418,106 | 12/1968 | Pierret | 75/0.5 BB |

*Primary Examiner*—W. Stallard

*Attorney, Agent, or Firm*—William S. Brown; Donald A. Gardiner

[57] ABSTRACT

Fine mesh metal powder, such at titanium powder, is prepared by reaction of a halide of the metal, in vapor form, with a fine spray of molten sodium at a temperature below the melting point of the metal.

9 Claims, 1 Drawing Figure

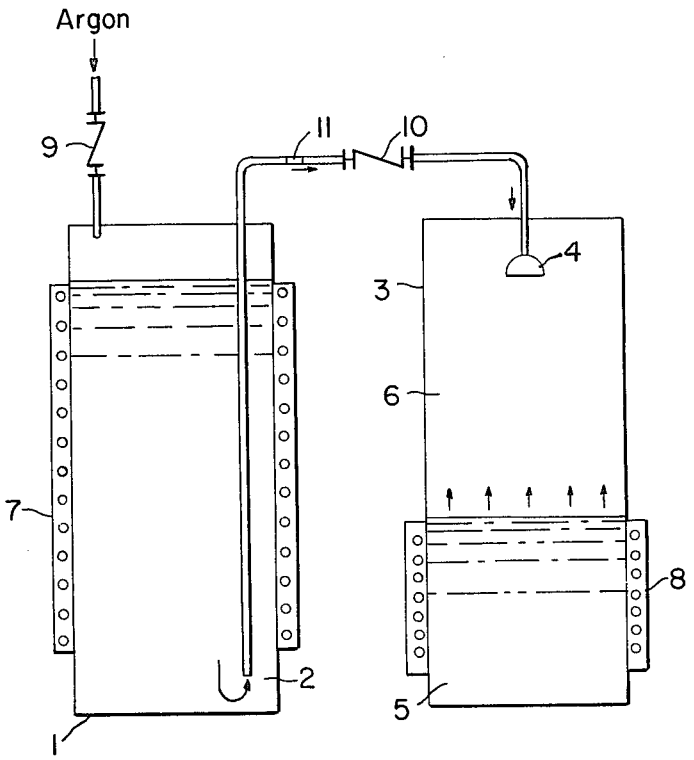
Argon
9
11
10
4
3
6
7
8
2
5
1

PRODUCTION OF METAL POWDER

This application is a continuation-in-part of application Ser. No. 200,109, filed Oct. 24, 1980, now abandoned.

The process of the invention relates to production of fine mesh metal powder from polyvalent metal halides such as titanium, columbium, hafnium, uranium, vanadium, and zirconium halides. Titanium and its alloys are especially useful because they exhibit an unusually favorable strength to weight ratio, with exceptionally good corrosion resistance. These properties make titanium desirable for numerous applications such as jet engine components, airframes, and valves. Also, titanium is virtually indestructible to corrosion in acid solutions.

The presently used methods for producing titanium metal consists of reducing titanium tetrachloride, $TiCl_4$, with either magnesium or sodium. The magnesium reduction process is commonly known as the Kroll process, and the sodium reduction process is commonly known as the Hunter process. Titanium metal produced from either process is in a form called sponge. Some sponge is used to make titanium powder and subsequently to make metal parts by powder metallurgy techniques. These parts are formed from titanium powder to near net shape, thus requiring little or no machining. Powder metallurgy, therefore, has the potential of producing parts at greatly reduced cost. Titanium powder is most commonly made by the rotating electrode and hydrogen dehydride process. Other processes for production of powder include electrolytic, centrifugal, shot cast, and direct grinding of sponge.

It has now been found, according to the process of the invention, that polyvalent metals such as titanium may be prepared directly in powder form, without intermediate formation of sponge, by reaction of the metal halide in vapor form with a fine spray of molten sodium under controlled reaction conditions. The invention will be more specifically described with reference to preparation of titanium powder; however, as stated above, the process of the invention is also applicable to preparation of other metals in powder form.

Fine mesh Ti powder is made, by means of the process of the invention, by spraying molten sodium through a fine spray nozzle into $TiCl_4$ vapor under controlled conditions of temperature and pressure. Control of temperature and pressure are essential for direct formation of Ti powder, as contrasted to the formation of Ti sponge in prior art processes. In particular, the reaction temperature must be maintained below the melting point of titanium. For this purpose, a reaction temperature of about 100° to 1200° C. is suitable. Since the reaction is highly exothermic, suitable means for control of the temperature must be provided.

It has been found that the required reaction temperature may be readily achieved and maintained by control of flow of the molten sodium into the $TiCl_4$ vapor-containing reaction vessel. It has also been found that this is most conveniently accomplished by means of a check valve in the molten sodium feed line, the valve being pressure-actuated to close when the pressure in the reactor exceeds the pressure in the molten sodium feed line. As the pressure in the reactor diminishes, a burst of sodium spray is again forced into the reactor. Thus, the reaction continues in increments, as a function of pressure and time. During the reaction, individual droplets of sodium, contained in a conical mist of the molten sodium, react with the $TiCl_4$ vapor to form discrete titanium particles surrounded by sodium chloride.

Temperatures of the sodium and $TiCl_4$ must, of course, be sufficient to maintain the reactants in molten and vapor form, respectively. Suitable temperatures of the molten sodium will generally range from about 125° to 250° C., with the temperature of the $TiCl_4$ vapor being in the range of about 100° to 250° C. Relative proportions of the two reactants are not critical, with stoichiometric amounts, based on the equation below, generally being most suitable.

An embodiment of the invention will be more specifically described with reference to the drawing which shows diagrammatically the apparatus employed in the example below.

Sodium is melted in a stainless steel container 1, and the molten sodium 2 is forced by argon pressure from the container into a second stainless steel container 3 via an atomizing nozzle 4.

Container 3, the reaction chamber, contains titanium tetrachloride 5, which is vaporized to form $TiCl_4$ vapor 6. Heat required to form the molten sodium and vaporize the $TiCl_4$ are supplied by heating elements 7 and 8. In addition, check valves 9 and 10 are provided to control the flow of argon and molten sodium (as discussed above), as well as preventing backflow of $TiCl_4$ vapor. A fine mesh screen cleaner 11 (about 48 to 100 mesh) is also provided to strain oxide particles or scale that might plug the check valve or spray nozzle.

Optimum argon pressure will depend on the amount of $TiCl_4$, desired reaction temperature, temperature of the molten sodium and the $TiCl_4$, and the size and shape of the reactor. As discussed above, in the preferred embodiment of the invention, the flow of molten sodium is controlled by the pressure of the reaction. It is thus apparent that the argon pressure, and hence the flow of the molten sodium, must be correlated with the remaining of the above-mentioned variables in order to maintain the reaction temperature within the desired range. Ordinarily, however, an argon pressure of about 100 to 400 psi, with a corresponding reaction pressure of about 150 to 450 psi, is satisfactory.

The atomized sodium, from nozzle 4, reacts with $TiCl_4$ vapor to form titanium powder and sodium chloride according to the reaction:

$$4Na + TiCl_4 \rightarrow Ti + 4NaCl.$$

Titanium is recovered from the reactor and separated from the salt mixture by dissolving the NaCl in cold water (about room temperature), preferably acidified with HCL to a pH of about 2. The fine titanium powder is filtered, washed with multiple cold water washes, and vacuum dried.

The following example will illustrate a specific embodiment of the invention.

EXAMPLE

An apparatus of the type described above was employed in this example.

The sodium container was evacuated in a vacuum chamber (not shown in drawing), backfilled with argon, and loaded under argon with 415 grams of sodium. The titanium tetrachloride reactor chamber was charged under argon with 854.7 grams of $TiCl_4$, a stoichiometric portion. The sodium container was connected to the reactor chamber by a transfer line comprising a high pressure check valve (6,000 psi), for control of flow of molten sodium and preventing backflow of $TiCl_4$, and a fine mesh screen cleaner to strain oxide particles or scale. An electrical heater was used to heat the transfer line to about 250° C., the sodium chamber was heated by band heaters to about 200° C. (outside surface temperature) and the reactor was heated by band heaters to about 100° C. (outside surface temperature).

The argon pressure was regulated to a maximum 98 psi and the sodium-line valve was rapidly opened. A muffled report indicated that sodium was flowing into the reactor. Electrical power was shut off to the reactor band heaters, and the reactor surface temperature dropped from 110° C. to 108° C. in 2 minutes, and then slowly increased for 66 minutes to a peak temperature of 213° C. The reaction proceeded in increments because of the opening and closing of the sodium-line check valve, the valve being forced closed with increased pressure of the reaction. When pressure inside the reactor dropped below the argon pressure (98 psi), sodium was again forced through the check valve. The reaction proceeded, with the reaction temperature ranging from about 110°to 250° C., until the $TiCl_4$ was completely reacted.

Titanium powder recovered was 211.5 grams. This powder was found to be all very fine; over 95 pct was −35 mesh and over 90 pct was contained in a −270 mesh fraction.

Although the process of the example is a batch process, the invention may also be practiced using a continuous process in which the sodium chamber is refilled at intervals, and molten NaCl containing the Ti powder is withdrawn through valves into a closed chamber to maintain a sealed reactor.

I claim:

1. A process for production of metal powder comprising reacting a halide of the metal, in vapor form, with a fine spray of molten sodium, the temperature of the reaction being below the melting point of the metal.

2. The process of claim 1 in which the metal is selected from the group consisting of titanium, columbium, hafnium, uranium, vanadium, and zirconium.

3. The process of claim 2 in which the metal is titanium.

4. The process of claim 3 in which the temperature of the reaction ranges from about 100° to 1200° C.

5. The process of claim 1 in which the halide is a chloride.

6. The process of claim 1 in which the metal halide is titanium tetrachloride.

7. The process of claim 1 in which the spray of molten sodium is obtained by atomizing the molten metal.

8. The process of claim 7 in which the atomization is achieved by means of a spray nozzle.

9. The process of claim 1 in which the temperature of the reaction is regulated by controlling the flow rate of the molten sodium into the reactor.

* * * * *